US008244166B2

(12) United States Patent
Lee

(10) Patent No.: US 8,244,166 B2
(45) Date of Patent: Aug. 14, 2012

(54) FUSING DEVICE AND IMAGE FORMING APPARATUS EMPLOYING THE SAME

(75) Inventor: Jing-Sung Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 496 days.

(21) Appl. No.: 12/485,087

(22) Filed: Jun. 16, 2009

(65) Prior Publication Data

US 2010/0098468 A1 Apr. 22, 2010

Related U.S. Application Data

(60) Provisional application No. 61/106,702, filed on Oct. 20, 2008.

(30) Foreign Application Priority Data

Dec. 26, 2008 (KR) ..... 10-2008-0134952

(51) Int. Cl.
*G03G 15/20* (2006.01)

(52) U.S. Cl. ..... 399/329; 399/122; 399/320; 399/330

(58) Field of Classification Search ..... 399/122, 399/329, 330, 331, 333
See application file for complete search history.

(56) References Cited

U.S. PATENT DOCUMENTS

| | | | | |
|---|---|---|---|---|
| 5,278,618 | A * | 1/1994 | Mitani et al. | 399/329 |
| 5,854,465 | A * | 12/1998 | Kishi et al. | 219/216 |
| 6,282,399 | B1 * | 8/2001 | Tokimatsu et al. | 399/330 |
| 6,393,230 | B1 * | 5/2002 | Haneda et al. | 399/69 |
| 6,442,365 | B1 * | 8/2002 | Schlueter et al. | 399/328 |
| 7,010,255 | B2 * | 3/2006 | Yura et al. | 399/328 |
| 7,340,192 | B2 * | 3/2008 | Kinouchi et al. | 399/69 |
| 7,624,288 | B2 * | 11/2009 | Kishi et al. | 713/300 |
| 7,697,881 | B2 * | 4/2010 | Hayashi et al. | 399/399 |
| 7,970,329 | B2 * | 6/2011 | Suzuki | 399/329 |
| 2005/0100372 | A1 * | 5/2005 | Fuma | 399/329 |
| 2006/0013607 | A1 * | 1/2006 | Yoshikawa | 399/69 |
| 2007/0274748 | A1 * | 11/2007 | Yoshikawa | 399/329 |
| 2007/0292175 | A1 * | 12/2007 | Shinshi | 399/329 |
| 2008/0138128 | A1 * | 6/2008 | Pirwitz | 399/329 |

FOREIGN PATENT DOCUMENTS

JP 2002072731 A * 3/2002

* cited by examiner

*Primary Examiner* — David Gray
*Assistant Examiner* — Francis Gray
(74) *Attorney, Agent, or Firm* — Stanzione & Kim, LLP

(57) ABSTRACT

Disclosed are a fusing device and an image forming apparatus employing the fusing device. The fusing device includes a belt having a closed loop configuration, a first roller rotatably disposed inside the loop defined by belt. The first roller includes heat absorbent layer. The fusing device further includes a second roller rotatably disposed outside the loop of the belt, the first and second rollers each make pressing contact with the portion of the belt that passes between them to form the fusing nip. The heat absorbent layer of the first roller provides heat for the fusing nip.

24 Claims, 6 Drawing Sheets

FUSING DEVICE AND IMAGE FORMING APPARATUS EMPLOYING THE SAME

CROSS-REFERENCE TO RELATED PATENT APPLICATIONS

This application claims the benefit of U.S. Patent Application No. 61/106,702, filed on Oct. 20, 2008, in the United States Patent and Trademark Office, and Korean Patent Application No. 10-2008-0134952, filed on Dec. 26, 2008, in the Korean Intellectual Property Office, the disclosures of which are incorporated herein by reference in their entirety.

TECHNICAL FIELD

The present disclosure relates to a fusing device for fusing a toner image to a recording medium by applying heat and pressure, and an image forming apparatus employing the same.

BACKGROUND OF RELATED ART

In general, an image forming apparatus is a peripheral device that may have the functionality of a copier, a printer, and/or a facsimile, for example, and which is capable of printing an image on a printing medium. Such an image forming apparatus can include an image forming unit and a fusing device. The image forming unit can include a photosensitive medium on which an electrostatic latent image can be formed, and a developing unit configured to develop the electrostatic latent image by using a developing agent. After the developed image is transferred to a printing medium, the fusing device can fuse the developed image to the printing medium by applying heat and pressure.

The fusing device can include a heat roller having a lamp heater and a pressure roller that is engaged with the heat roller to form a fusing nip. In the above-structured fusing device, because the thermal capacity of the heat roller can be high and all surfaces of the heat roller are heated, heating the fusing device to a predetermined fusing temperature may take a relatively long time. Moreover, the fusing nip is formed where the heat roller and the pressure roller are engaged with each other, and thus, the fusing nip has a relatively narrow width.

SUMMARY OF THE DISCLOSURE

According to an aspect of the present disclosure, a fusing device may be provided to include a belt having a closed loop configuration; a first roller rotatably disposed inside a loop defined by the belt, the first roller having a metallic layer formed on an outer circumferential surface thereof; a second roller rotatably disposed outside the loop, the first and second rollers each being in a pressing contact with a portion of the belt that passes therebetween; and a first heat source disposed inside the belt.

The first roller may include a core and an elastic layer formed over the core, the metallic layer of the first roller being formed over the elastic layer.

The first roller may further includes an insulating layer formed between the elastic layer and the metallic layer.

The core of the first roller may have a hollow inner portion. The fusing device may further comprise a second heat source disposed inside the hollow inner portion of the core.

The belt may include a substrate and an elastic layer formed over a first side of the substrate. The substrate may include a metallic layer.

The belt may include a coating layer formed over a second side opposite the first side of the substrate of the belt. The coating layer may be heat absorbent.

The belt may include a separation layer formed over the elastic layer. The separation layer may promote separation of the belt from a printing medium on which a toner image is fused by the fusing device.

The belt may be configured to move past the first and second rollers in a tensionless state.

The fusing device may further comprise a belt guide disposed inside the loop of the belt. The belt guide may be spaced apart from the first roller to support a section of the belt that is away from the first roller.

The belt guide may be configured to support the belt in such a manner as to reduce a lateral movement of the belt in a direction of a width of the belt so as to mitigate skewing of the belt.

The fusing device may further comprise a third roller disposed inside the loop at a location spaced apart from the first roller. The third roller may support a section of the belt that is away from the first roller in such a manner to maintain the belt in a tensioned state.

The fusing device may further comprise a second heat source disposed inside the third roller.

According to another aspect, an image forming apparatus may be provide to include a print unit and a fusing device. The print unit may be configured to develop an electrostatic latent image using a developing agent to produce a visible developed image, and to transfer the visible developed image onto a printing medium. The fusing device may be configured to fix the visible developed image on the printing medium. The fusing device may comprise a belt having a closed loop configuration; a first roller rotatably disposed inside a loop defined by the belt, the first roller having a metallic layer formed on an outer circumferential surface thereof; a second roller rotatably disposed outside the loop, the first and second rollers each being in a pressing contact with a portion of the belt that passes therebetween; and a first heat source disposed inside the belt.

According to yet another aspect, a fusing device usable in an image forming apparatus for fixing a toner image onto a printing medium may comprise a belt defining a closed loop; a first member disposed inside the loop defined by the belt, the first member including a heat absorbent material; and a second member disposed outside the loop, the first and second members each being in a pressing contact with a portion of the belt that passes therebetween so as to cause a fusing nip to form between the portion of the belt that passes between the first and second members and the second member, the first member being configured to receive heat from a heat source, and to direct the received heat toward the fusing nip.

BRIEF DESCRIPTION OF THE DRAWINGS

Various features and advantages of the present disclosure will become more apparent by describing several embodiments thereof with reference to the attached drawings, in which.

DETAILED DESCRIPTION OF SEVERAL EMBODIMENTS

Hereinafter, several embodiments of a fusing device and an image forming apparatus employing the same will be described more fully with reference to the accompanying drawings.

Figure 1:
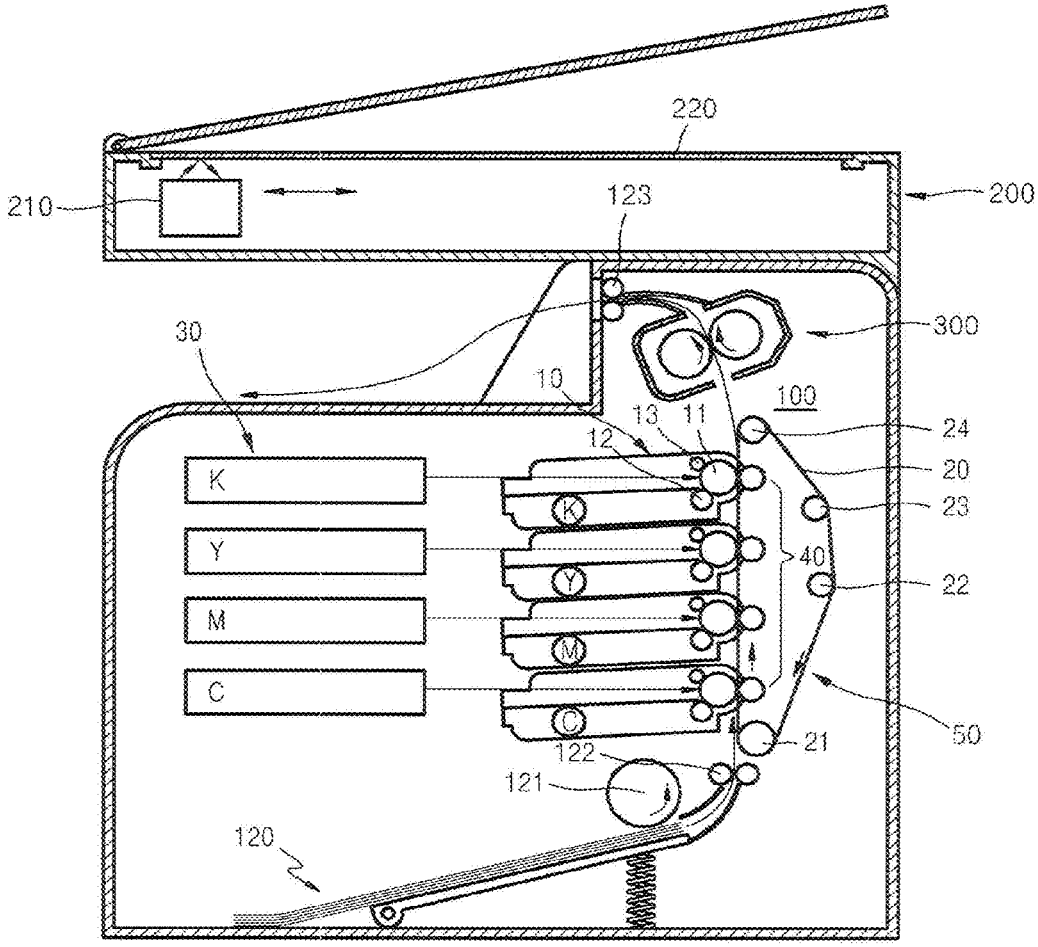
FIG. 1 illustrates an implementation of an image forming apparatus according to an embodiment of the present disclosure.

FIG. 1 schematically illustrates an implementation of an image forming apparatus according to an embodiment of the present disclosure. FIG. 1 illustrates a print unit 100 configured to print an image on a printing medium (e.g., paper) according to an electro-photographic process, and a fusing device 300. In one or more of the embodiments described herein, the image forming apparatus can be a dry type electro-photographic image forming apparatus configure to use a dry developing agent (hereinafter referred to as 'toner').

The print unit 100 can include an exposure unit 30, a developing unit 10, and a transfer unit 50. To print a color image, the print unit 100 can include developing units 10C, 10M, 10Y, and 10K, which respectively contain cyan (C) toner, magenta (M) toner, yellow (Y) toner, and black (K) toner. The print unit 100 can include exposure units 30C, 30M, 30Y, and 30K respectively corresponding to the developing units 10C, 10M, 10Y, and 10K.

Each of the developing units 10C, 10M, 10Y, 10K can include a photosensitive drum 11, which can be used as an image forming unit on which an electrostatic latent image can be formed, and a developing roller 12 configured to develop the electrostatic latent image. A charging bias can be applied to a charging roller 13 to charge the outer circumferential surface of the photosensitive drum 11 with a uniform electric potential. In some embodiments, a corona charger (not shown) can be used instead of the charging roller 13. Toner can be supplied to the photosensitive drum 11 by transferring the toner attached to the outer circumferential surface of the developing roller 12. To this end, a developing bias can be applied to the developing roller 12 to supply the toner to the photosensitive drum 11. In each of the developing units 10C, 10M, 10Y, and 10K, there can be disposed a supply roller (not shown) configured to attach the toner contained in the corresponding developing unit to the developing roller 12, a regulating unit (not shown) configured to regulate the amount of toner attached to the developing roller 12, and an agitator (not shown) configured to transfer the toner contained in the corresponding developing unit to the supply roller and/or to the developing roller 12. Each of the developing units 10C, 10M, 10Y, and 10K can include a cleaning blade (not shown) configured to remove the toner from the outer circumferential surface of the photosensitive drum 11 before charging the photosensitive drum 11, and a receiving space (not shown) configured to contain the removed toner.

For example, the transfer unit 50 can include a paper conveyor belt 20 and transfer rollers 40. The paper conveyor belt 20 can be disposed opposite (e.g., facing) the outer circumferential surface of the photosensitive drum 11 that is exposed outside of each of the developing units 10C, 10M, 10Y, and 10K. The paper conveyor belt 20 can move in a circular direction while being supported by multiple support rollers 21, 22, 23 and 24. In one embodiment, the paper conveyor belt 20 can be disposed in a substantially vertical direction. The transfer rollers 40 can be arranged opposite to the photosensitive drums 11 of the respective developing units 10C, 10M, 10Y, and 10K, and the paper conveyor belt 20 can be positioned between the transfer rollers 40 and the photosensitive drums 11. A transfer bias can be applied to the transfer roller 40. The exposure units 30C, 30M, 30Y, and 30K can be configured to scan a light onto the photosensitive drums 11 of the respective developing units 10C, 10M, 10Y, and 10K. The light scanned by the exposure units 30C, 30M, 30Y, and 30K can correspond to C, M, Y, and K images, respectively. In one embodiment, laser scanning units (LSU) having a laser diode configured to be used as a light source can be used as the exposure units 30C, 30M, 30Y, and 30K.

A method of forming a color image by using such an image forming apparatus is described below.

Referring to FIG. 1, the photosensitive drums 12 of the respective developing units 10C, 10M, 10Y, and 10K can be charged to a uniform electric potential by applying a charging bias to the charging roller 13. The exposure units 30C, 30M, 30Y, and 30K can each scan lights that correspond to information of one of C, M, Y and K images onto the photosensitive drums 11 of their respective developing units 10C, 10M, 10Y, and 10K to produce an electrostatic latent image. A developing bias can be applied to the developing roller 12. The toner can be transferred from the outer circumferential surface of the developing roller 12 to the electrostatic latent image such that C, M, Y and K toner images can be formed on the photosensitive drum 11 of the respective developing units 10C, 10M, 10Y, and 10K.

A printing medium, such as paper, can be fed from a cassette 120 by a pickup roller 121. The paper can be directed toward the paper conveyor belt 20 via a feed roller 122, and may adhere to a surface of the paper conveyor belt 20 by an electrostatic force. The paper can be fed at a speed that is substantially the same as the moving speed of the paper conveyor belt 20.

In one example, the front end of the paper can arrive at a transfer nip when the front end of the C toner image formed on the outer circumferential surface of the photosensitive drum 11 of the developing unit 10C arrives at the transfer nip facing the transfer roller 40. When a transfer bias is applied to the transfer roller 40, the C toner image is transferred from the photosensitive drum 11 to the paper. As the paper is fed, each of the remaining M, Y and K toner images formed on the photosensitive drum 11 of their respective developing units 10M, 10Y, and 10K, can be sequentially transferred to the paper in such a manner that the toner images overlap each other on the paper, and form a color toner image on the paper.

The color toner image can be retained on the paper by an electrostatic force. A fusing unit 300 can be configured to fuse the color toner image to the paper by applying heat and pressure thereto. The paper with the fused color toner image can be discharged to a space outside of the image forming apparatus via a discharging roller 123. In the above described embodiment, the toner images on the photosensitive drums 11 can be directly transferred to the paper without having to perform an intermediate transfer. In other embodiments, however, the toner images developed on the photosensitive drums 11 can be transferred to an intermediate medium (not shown) before being transferred to the paper.

The image forming apparatus can further include a scanner 200 configured to read image information from an original image. For example, the scanner 200 can be configured to read the image information from the original image by scanning light onto the original image and detecting the light reflected from the original image with a read unit 210. The read unit 210 can be a contact type image sensor (CIS), a charge-coupled device (CCD), or other like device, for example. In one example, the scanner 200 can be a flat-bed type scanner in which the original image can be placed on a platen 220 and the read unit 210 can move in a sub-scanning direction. In another example, the scanner 200 can have a structure in which the read unit 210 can be in a fixed location and the original image can move in the sub-scanning direction. In yet another example, the scanner 200 can have a structure that combines at least some of the aspects of the above-described structures. The image information read by the scanner 200 can be transmitted to a communication device (not shown), such as universal serial bus (USB), for example, via a host (not shown). The image information read by the scanner 200 can be printed on the paper by the print unit 100, and thus, the image forming apparatus can function as a copier. The image forming apparatus can include a line controller (not shown) so that the image forming apparatus can function as a facsimile and be configured to transmit the image information scanned from the original image via a public line, for example.

In one embodiment, the image forming apparatus can be a single-path type color image forming apparatus. The image forming apparatus, however, need not be so limited. In another embodiment, the image forming apparatus can be a multi-path color image forming apparatus. In yet another embodiment, the image forming apparatus can be a monochromatic image forming apparatus.

Figure 2:
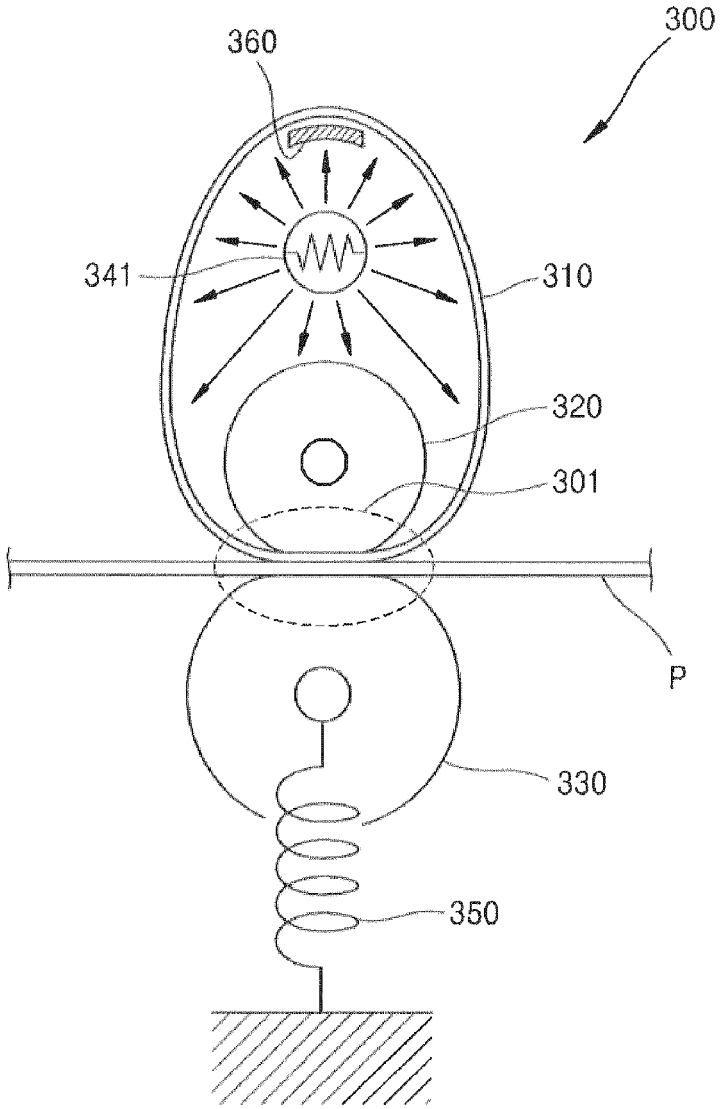
FIG. 2 illustrates an implementation of a fusing device employed in the image forming apparatus of FIG. 1 according to an embodiment of the present disclosure.

FIG. 2 illustrates an implementation of a fusing device 300 usable in the image forming apparatus of FIG. 1 according to an embodiment of the present disclosure. Referring to FIG. 2, the fusing device 300 can include a fusing belt 310, first and second rollers 320 and 330, and a first heat source 341. The first roller 320 can be disposed or located inside the fusing belt 310. The fusing belt 310 can have a closed loop structure or configuration. The second roller 330 can be disposed outside the fusing belt 310. To form a fusing nip 301, the first and second rollers 320 and 330 can be configured to be in a pressing engagement with each other in such a manner as to rotate together while having the fusing belt 310 placed therebetween. An elastic unit 350 (e.g., spring) can be configured to apply an elastic force to the first roller 320 and/or to the second roller 330 along a direction in which the first and second rollers 320 and 330 are engaged with each other.

Figure 3:
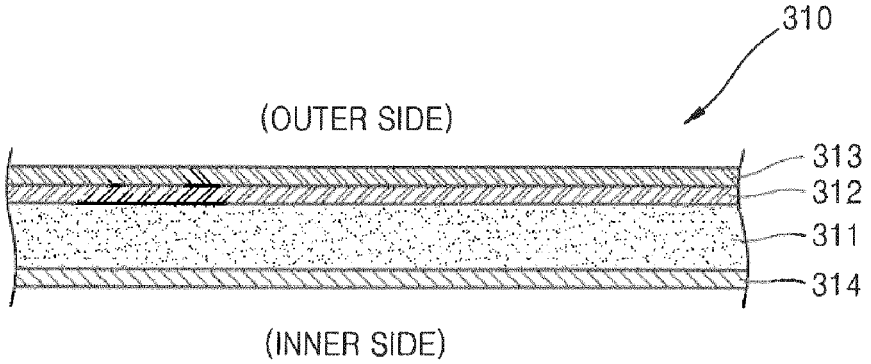
FIG. 3 is a cross-sectional view of a fusing belt according to an embodiment of the present disclosure.

As illustrated in FIG. 3, the fusing belt 310 can include an elastic layer 312 and a separation layer 313 formed on a surface of a substrate 311. The separation layer 313 can be made of a perfluoroalkoxy (PFA) copolymer, for example. In the substrate 311, a black coating layer 314 can be formed to absorb radiant heat generated by the first heat source 341. The substrate 311 can be a thin metallic layer such as a thin stainless steel layer, for example. The thickness of the substrate 311 can be determined so that a portion of the fusing belt 310 can be elastically deformed near the fusing nip 301, and so that it can be restored to its original state when that portion of the fusing belt 310 moves away from the fusing nip 301. The substrate 311 can be a thin layer made of stainless steel and having a thickness of about 35 microns, for example. The elastic layer 312 can be a rubber layer having a thickness of about 200 microns, for example. The thicknesses and/or composition of the various layers of the fusing belt 310 need not be limited to the examples provided above.

Figure 4:
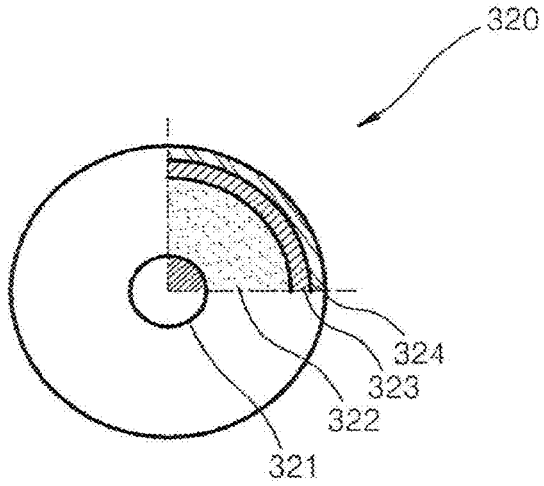
FIG. 4 is a cross-sectional view of a first roller according to an embodiment of the present disclosure.

As illustrated in FIG. 4, the first roller 320 can include a thin metallic layer 324. The thin metallic layer 324 can be an outermost layer constituting the first roller 320. An elastic layer 322 can be formed between a core 321 and the thin metallic layer 324. When the first and second rollers 320 and 330 are engaged with each other, the elastic layer 322 can be deformed to allow the fuse nip 301 to form. An insulating layer 323 can be formed between the elastic layer 322 and the thin metallic layer 324 to prevent thermal energy, which is generated by the first heat source 341 and absorbed by the thin metallic layer 324, from being delivered to the elastic layer 322. In addition to preventing the surface of the elastic layer 322 from being rapidly overheated by the radiant heat generated by the first heat source 341, the insulating layer 322 can also allow the thermal energy absorbed by the thin metallic layer 324 to be efficiently delivered to the fusing nip 301. The thickness of the thin metallic layer 324 can be determined so that the thin metallic layer 324 can be elastically deformed to create a fusing nip 301 of sufficient size, and so that the thin metallic layer 324 can be restored to its original state when the first roller 320 moves away from the fusing nip 301. The thin metallic layer 324 can be a thin layer made of stainless steel having a thickness of about 35 microns, for example. The insulating layer 323 can be a mica layer having a thickness of about 100 microns, for example. The thicknesses and/or composition of the various layers of the first roller 320 need not be limited to the examples provided above.

The second roller 330 can be a metallic roller, for example. The second roller 330 can be fabricated by, for example, forming an elastic layer on a metallic roller.

The first heat source 341 can be disposed inside the fusing belt 310. Heat generated by the first heat source 341 can be delivered to the fusing belt 310 and to the first roller 320. The heat generated by the first heat source 341 is mostly delivered to the substrate 311 of the fusing belt 310 and to the thin metallic layer 324 of the first roller 320. Various heating devices (e.g., a heating lamp, such as, e.g., a halogen lamp, induction heater, or the like) can be used as the first heat source 341. Although the embodiment shown in FIG. 2 illustrates one first heat source 341 disposed inside the fusing belt 310, other embodiments can have two or more first heat sources 341 disposed inside the fusing belt 310 or elsewhere.

A front surface of the printing medium P having the toner image can be in contact with the fusing belt 310 and a back surface of the printing medium P can be supported by the second roller 330. The temperature of the fusing belt 310 can increase because the fusing belt 310 can be directly heated by the first heat source 341, and can also be indirectly heated by the first roller 320 because of the thermal energy absorbed by the first roller 320 from the first heat source 341. The toner image can be fused to the printing medium P because of the temperature of the fusing belt 310. Moreover, the fused toner image can be pressed so that it attaches to the printing medium P by having the first and second rollers 320 and 330 engaged with each other. As a result of the application of heat and pressure, the toner image can be fused to the printing medium P.

According to some embodiments, a nip forming unit (not shown) can be employed instead of the first roller 320. The nip forming unit can be fixedly disposed inside the fusing belt 310, and can be configured to apply pressure to the second roller 330. When a nip forming unit is used, however, a slip can occur between the second roller 330 and the fusing belt 310. Such a slip can occur, for example, during an initial stage when the second roller 330 begins to rotate. To prevent the slip between the fusing belt 310 and the second roller 330, a higher amount of pressure than a typical amount of pressure can be applied to the second roller 330. Because a slip occurs between the fusing belt 310 and the nip forming unit to allow the fusing belt 310 to move, it may be difficult to apply such a higher pressure to the nip forming unit or to the second roller 330. Thus, a lubricant can be used on the surface of the nip forming unit or the fusing belt 310 to allow the fusing belt 310 to move.

Because the fusing belt 310 is moved by the first and second rollers 320 and 330 when rotating together while engaged with each other, a slip is less likely to occur between the fusing belt 310 and the first and second rollers 320 and 330. Thus, the fusing belt 310 can move stably. Moreover, because the first roller 320 rotates, a higher pressure can be applied to the first roller 320 and/or to the second roller 330 to allow a stable fusing nip 301 to be formed. Because the first roller 320 rotates, no lubricant may need to be applied between the first roller 320 and the fusing belt 310.

The thin metallic layer 324 of the first roller 320 allows the heat generated by the first heat source 341 to be rapidly absorbed and delivered to the fusing nip 301. In other words, because of its small thickness, the thin metallic layer 324 can be rapidly heated by thermal energy generated by the first heat source 341. The absorbed thermal energy can be quickly delivered to the fusing nip 301 by heat conduction performed by the thin metallic layer 324 and the rotation of the first roller 320. Moreover, when the insulating layer 323 is formed between the thin metallic layer 324 and the elastic layer 322, the thermal energy can be more effectively delivered to the fusing nip 301 by reducing thermal losses that occur from the thin metallic layer 324 to the elastic layer 322. The substrate 311 of the fusing belt 310, which is a thin metallic layer, can also allow the heat from the first heat source 341 to be rapidly absorbed and delivered to the fusing nip 301 in a manner that is substantially similar to the manner in which heat is absorbed and delivered by the thin metallic layer 324 of the first roller 320. The black coating layer 314 of the fusing belt 310 is configured to allow the thermal energy generated by the first heat source 341 to be more effectively absorbed. As described above, in the fusing device 300, the temperature of the fusing nip 301 can be rapidly increased to a fusing temperature and maintained at the fusing temperature by effectively absorbing and delivering heat. According to an experimental example, a time needed to increase the temperature of an outer surface of the fusing belt 310 from about 10 degrees Celsius (° C.) to about 180° C. is about half the time that is required by a conventional fusing device. According to another experimental example, an upper limit of a printing speed that provides a fusing quality of about 90% is about 38 pages-per-minute (ppm); which is a higher printing speed than that achievable when a conventional fusing device is used. The above mentioned experiments were conducted to analyze the heating time and/or printing speed of various embodiments. The operation of the embodiments described herein need not be limited to achieving the above mentioned heating time and/or printing speed.

Figure 5:
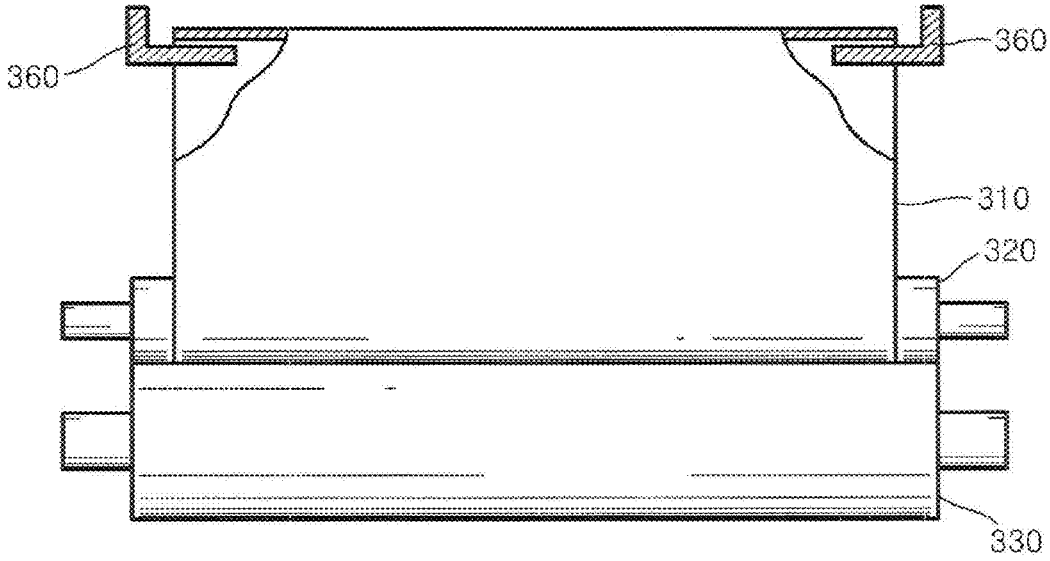
FIG. 5 illustrates the arrangement of a belt guide according to an embodiment of the present disclosure.

Referring to FIGS. 2 and 5, a belt guide 360 is illustrated. The fusing belt 310 can be moved in a tensionless state. That is, the fusing belt 310 can be moved by the rotation of the first and second rollers 320 and 330 without having a tensile force applied to the fusing belt 310. The belt guide 360 can be configured to prevent the fusing belt 310 from hanging down. Thus, the belt guide 360 can loosely support the fusing belt 310 so that a tensile force need not be applied to the fusing belt 310. Moreover, the belt guide 360 can be configured to guide an end of the fusing belt 310 in a direction of the width of the fusing belt 310 to prevent the fusing belt 310 from skewing. The belt guide 360 can be configured to guide both ends of the fusing belt 310 instead of the entire width of the fusing belt 310. A loss of heat produced by the first heat source 341 via the belt guide 360 can be minimized by using the belt guide 360 having a small size that is sufficient to guide the fusing belt 310.

Figure 6:
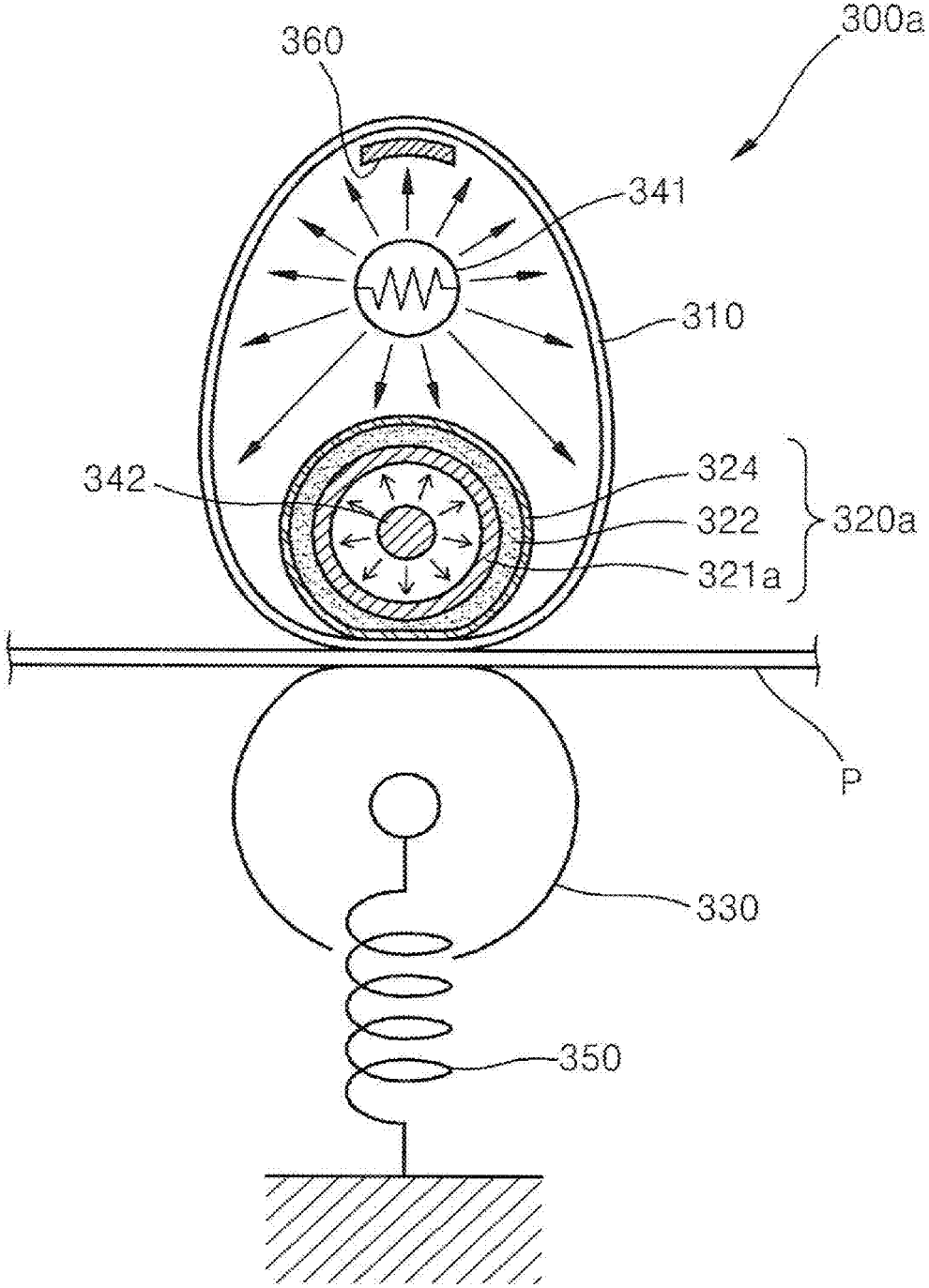
FIG. 6 illustrates an implementation of a fusing device according to another embodiment of the present disclosure.

FIG. 6 illustrates an implementation of a fusing device 300*a* according to another embodiment of the present disclosure. The fusing device 300*a* can be substantially the same as the fusing device 300 illustrated in FIG. 2, and may additionally have a second heat source 342 disposed within a first roller 320*a*. In this embodiment, a core 321*a* of the first roller 320*a* can have a hollow inner portion (e.g., hollow pipe) such that the second heat source 342 can be disposed inside the first roller 320*a*. An elastic layer 322 and a thin metallic layer 324 can be formed outside the core 321*a*. Various heating devices, such as a heating lamp (e.g., halogen lamp) or an induction heater, for example, can be used as the second heat source 342.

Figure 7:
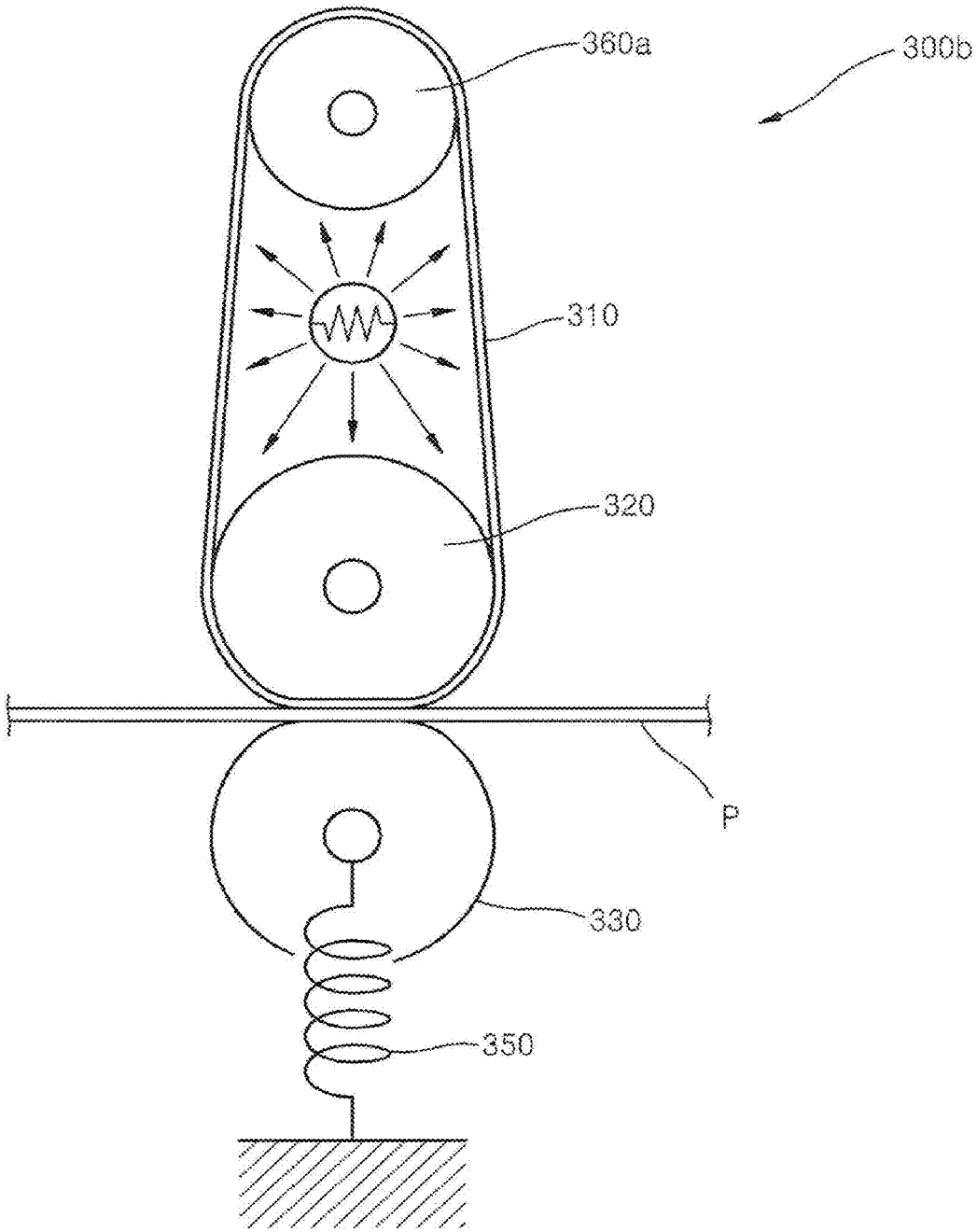
FIG. 7 illustrates an implementation of a fusing device according to another embodiment of the present disclosure.

FIG. 7 illustrates an implementation of a fusing device 300*b* according to another embodiment of the present disclosure. The fusing device 300*b* can be substantially the same as the fusing device 300 illustrated in FIG. 2, and can be configured to have the fusing belt 310 moving in a tensioned state. Instead of using the belt guide 360 as illustrated in FIG. 6, a support roller 360*a* configured to support the fusing belt 310 in cooperation with the first roller 320 in a tensioned state can be disposed inside the fusing belt 310. In another embodiment, the first roller 320*a* illustrated in FIG. 6 can be used in the fusing device 300*b* instead of the first roller 320 illustrated in FIG. 2.

Figure 8:
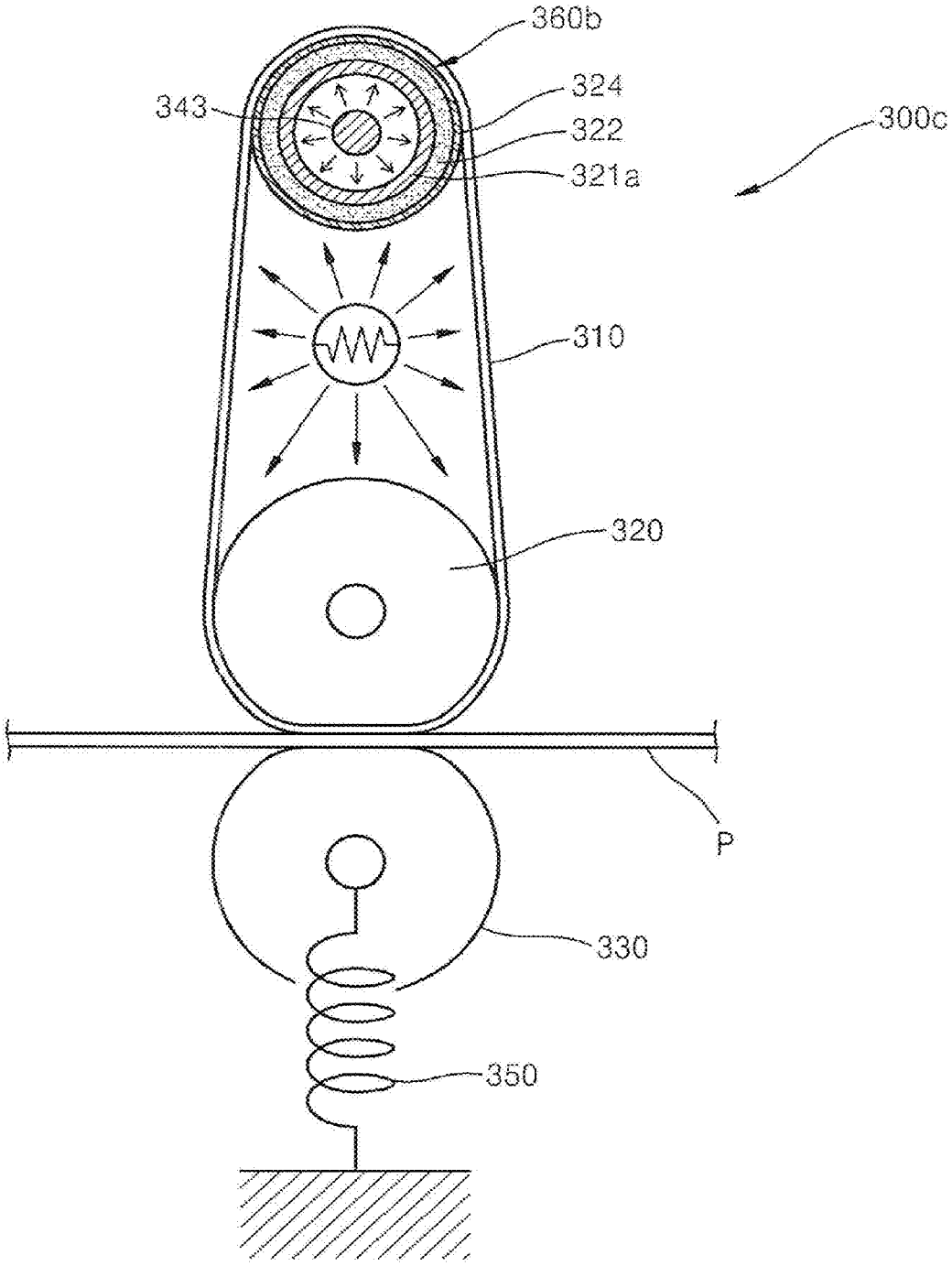
FIG. 8 illustrates an implementation of a fusing device according to another embodiment of the present disclosure.

FIG. 8 illustrates an implementation of a fusing device 300*c* according to yet another embodiment of the present disclosure. The fusing device 300*c* can be substantially the same as the fusing device 300*b* illustrated in FIG. 7, and can have a support roller 360*b* (e.g., a hollow pipe) instead of the support roller 360*a* illustrated in FIG. 7. A third heat source 343 can be disposed within the support roller 360*b*. Various heating devices, such as a heating lamp (e.g., a halogen lamp) or an induction heater, for example, can be used as the third heat source 343. The support roller 360*b* can have substantially the same configuration as the first roller 320*a* illustrated in FIG. 6. In another embodiment, the first roller 320*a* having the second heat source 342, and as illustrated in FIG. 6, can be used in the fusing device 300*c* instead of the first roller 320 illustrated in FIG. 2.

While the present disclosure has been described with reference to several embodiments, it will be understood by those of ordinary skill in the art that various changes in form and details may be made therein without departing from the spirit and scope of the present disclosure as defined by the following claims.

What is claimed is:

1. A fusing device, comprising:

a belt defining a closed loop and comprising a black coating layer disposed on an inner surface of the loop to absorb radiant heat;

a first roller rotatably disposed inside the loop, the first roller comprising a metallic layer disposed on an outer circumferential surface thereof;

a second roller rotatably disposed outside the loop, the first and second rollers each being in a pressing contact with a portion of the belt that passes therebetween; and a first heat source disposed inside the loop and outside of the first roller, to radiate heat onto the black coating layer of the belt and the metallic layer of the first roller.

2. The fusing device of claim 1, wherein the first roller comprises:
a core; and
an elastic layer disposed between the core and the metallic layer.

3. The fusing device of claim 2, wherein the first roller further comprises an insulating layer disposed between the elastic layer and the metallic layer.

4. The fusing device of claim 2, wherein:
the core has a hollow inner portion; and
the fusing device further comprises a second heat source disposed inside the hollow inner portion of the core.

5. The fusing device of claim 1, wherein the belt comprises:
a substrate disposed around the coating layer and comprising a metallic layer; and
an elastic layer disposed around the substrate.

6. The fusing device of claim 5, wherein the belt comprises a separation layer disposed on around the elastic layer, the separation layer to promote the separation of the belt from a printing medium on which a toner image is fused by the fusing device.

7. The fusing device of claim 1, wherein the belt is configured to move past the first and second rollers in a tensionless state.

8. The fusing device of claim 7, further comprising:
a belt guide disposed inside the loop to support a section of the belt.

9. The fusing device of claim 8, wherein the belt guide is configured to mitigate skewing of the belt.

10. The fusing device of claim 1, further comprising:
a third roller disposed inside the loop to maintain the belt in a tensioned state.

11. The fusing device of claim 10, further comprising:
a second heat source disposed inside the third roller.

12. An image forming apparatus, comprising:
a print unit configured to develop an electrostatic latent image using a developing agent to produce a visible developed image, the print unit being configured to transfer the visible developed image onto a printing medium; and
a fusing device configured to fix the visible developed image on the printing medium, the fusing device comprising:
a belt defining a closed loop and comprising a black coating layer disposed on an inner surface of the loop to absorb radiant heat;
a first roller rotatably disposed inside the loop and comprising a metallic layer formed on the outer surface thereof;
a second roller rotatably disposed outside the loop, the first and second rollers each being in a pressing contact with a portion of the belt that passes therebetween; and
a first heat source disposed inside the loop and outside of the first roller, to radiate heat onto the black coating layer of the belt and the metallic layer of the first roller.

13. The image forming apparatus claim 12, wherein the first roller comprises:
a core; and
an elastic layer disposed between the core and the metallic layer.

14. The image forming apparatus claim 13, wherein the first roller further comprises an insulating layer disposed between the elastic layer and the metallic layer.

15. The image forming apparatus claim 13, wherein:
the core has a hollow inner portion; and
the fusing device further comprises a second heat source disposed inside the hollow inner portion of the core.

16. The image forming apparatus claim 12, wherein the belt comprises:
a substrate comprising a metallic layer; and
an elastic layer; and
a substrate disposed between the black coating layer and the elastic layer and comprising a metallic layer.

17. The image forming apparatus claim 16, wherein the belt comprises a separation layer disposed around the elastic layer to promote separation of the belt from a printing medium.

18. The image forming apparatus claim 12, wherein the belt is configured to move past the first and second rollers in a tensionless state.

19. The image forming apparatus claim 18, wherein the fusing device further comprises:
a belt guide disposed inside the loop to support a section of the belt.

20. The image forming apparatus claim 19, wherein the belt guide is configured to mitigate skewing of the belt.

21. The image forming apparatus claim 18, wherein the fusing device further comprises:
a third roller disposed inside the loop to apply tension to the belt.

22. The image forming apparatus claim 21, wherein the fusing device further comprises:
a second heat source disposed inside the third roller.

23. A fusing device usable in an image forming apparatus for fixing a toner image onto a printing medium, comprising:
a belt defining a closed loop;
a first member disposed inside the loop and comprising:
a solid non-hollow core;
a metallic layer disposed around the solid non-hollow core; and
an insulating layer disposed between the solid non-hollow core and the metallic layer;
a second member disposed outside the loop, the first and second members each being in a pressing contact with a portion of the belt that passes therebetween so as to cause a fusing nip to form between the portion of the belt that passes between the first and second members; and
a heat source disposed inside of the loop and outside of the first member, to radiate heat onto the metallic layer of the first member and the belt.

24. A fusing device comprising:
a belt defining a closed loop;
a first roller rotatably disposed inside of the loop, the first roller comprising a metallic layer disposed on an outer circumferential surface thereof;
a second roller rotatably disposed outside of the loop, the first and second rollers being in pressing contact with a portion of the belt disposed therebetween; and
a first heat source disposed inside of the belt and outside of the first roller, to radiate heat to the metallic layer.

* * * * *